US005474843A

United States Patent [19]

Lambert et al.

[11] Patent Number: 5,474,843

[45] Date of Patent: Dec. 12, 1995

[54] ACCEPTOR MATERIAL FOR INKS

[75] Inventors: Ronald F. Lambert, Wayland, Mass.; Edward J. Johnson, Fairport, N.Y.

[73] Assignee: Labelon Corporation, Canandaigua, N.Y.

[21] Appl. No.: 168,848

[22] Filed: Dec. 16, 1993

[51] Int. Cl.[6] ..... B41M 5/00

[52] U.S. Cl. ..... 428/327; 428/195; 428/206; 428/409; 428/474.4

[58] Field of Search ..... 428/195, 327, 428/447, 478.2, 478.8, 206, 404, 474.4

[56] References Cited

U.S. PATENT DOCUMENTS

| | | | |
|---|---|---|---|
| 4,371,582 | 2/1983 | Sugryama et al. | 428/341 |
| 4,379,804 | 4/1983 | Eisele et al. | 428/332 |
| 4,381,185 | 4/1983 | Swanson et al. | 8/506 |
| 4,547,405 | 10/1985 | Bedell eet al. | 428/323 |
| 4,554,181 | 11/1985 | Cousins et al. | 428/341 |
| 4,578,285 | 3/1986 | Viola | 428/195 |
| 4,785,313 | 11/1988 | Higuma et al. | 346/1.1 |
| 4,857,386 | 8/1989 | Butters et al. | 428/206 |
| 4,877,680 | 10/1989 | Sakaki et al. | 428/500 |
| 4,935,307 | 6/1990 | Iqbal et al. | 428/500 |
| 4,944,988 | 7/1990 | Yasuda et al. | 428/195 |
| 5,180,425 | 1/1993 | Matrick et al. | 106/22 R |
| 5,180,624 | 1/1993 | Kojima et al. | 428/211 |
| 5,183,502 | 2/1993 | Meichsnër et al. | 106/22 K |
| 5,190,805 | 3/1993 | Atherton et al. | 428/195 |
| 5,192,617 | 3/1993 | Stofko et al. | 428/411.1 |
| 5,206,071 | 4/1993 | Atherton et al. | 428/195 |
| 5,219,928 | 6/1993 | Stofko, Jr. et al. | 428/331 |
| 5,223,338 | 6/1993 | Malhotra | 428/195 |

FOREIGN PATENT DOCUMENTS

| | | | |
|---|---|---|---|
| 0484016A1 | 10/1991 | European Pat. Off. | 428/195 |
| WO92/07722 | 5/1992 | WIPO | 428/195 |

OTHER PUBLICATIONS

"The Theory of the Photographic Process," Macmillan Publishing Co., Inc., New York, Fourth Edition, T. H. James, Editor; (see Chapter III, pp. 77–87, by Burness and Pouradier, entitled The Hardening of Gelatin and Emulsions).

Esprit Chemical Co. brochure, "MR Series" published prior to Dec. 16, 1993.

*Primary Examiner*—Pamela R. Schwartz

*Attorney, Agent, or Firm*—Nixon, Hargrave, Devans & Doyle

[57] ABSTRACT

An acceptor material for printing by ink-jet printers forms quick-drying, water-resistant, light-stable ink records with aqueous ink jet inks. The material comprises a support such as polyester film and a coated layer containing a water-soluble mordant that forms insoluble compounds with and immobilizes the dyestuffs of the ink jet inks and a hardened water managing polymer, preferably, hardened gelatin, which contains polymeric beads that protrude from the layer.

16 Claims, 2 Drawing Sheets

ACCEPTOR MATERIAL FOR INKS

RELATED APPLICATIONS

Reference is made to concurrently filed and commonly owned patent application Ser. Nos. 08/168,467 and 08/168,849 of Ronald F. Lambert entitled "Ink Acceptor Material Containing a Phospholipid" and "Ink Acceptor Material Containing an Amino Compound", respectively.

FIELD OF THE INVENTION

This invention relates to an acceptor material for ink printing and, more particularly, to a coated acceptor material for forming water-resistant, light-stable ink records with ink jet inks.

BACKGROUND OF THE INVENTION

Ink jet printing is a non-impact means of producing a pattern of ink droplets which can be used to record digital information. To make a hard copy, the droplets are deposited onto a transparent, translucent, or opaque support such as film, vellum or paper. Ink jet printers have been used for many years to make monochrome hard copy from computers. A rapidly-growing use of ink jet printers is to generate subtractive color images using a three- or four-color process. The resultant hard copy can be viewed by transmitted light using an overhead projector (transparent film); by transmitted light using a diffuse illuminator (translucent film); or by reflected light (opaque support).

In subtractive continuous tone silver halide color photography, color images are produced by the superposition of three primary continuous-tone color-intensity-graduated recording layers. In non-continuous tone ink jet color printing, use is made of microscopic superposed color-separated dots (so-called halftone images) to create an impression to the viewer of an intensity graduated image. The proper hue, size, and degree of coalescence and mixing of the primary color dots—cyan, magenta, yellow and black—are necessary for the faithful reproduction of color on the recording medium. Accurate ink jet color image recording thus requires a high degree of cooperation between the ink jet color separation pulses, the ink dyestuffs, and the ink acceptor material.

An ink acceptor material should be capable of accepting the droplets readily and allowing them to coalesce, yet should achieve color isolation and separation with high chroma and pure hue without image edge distortions due to poor registration, bleeding, feathering, or other image quality defects. Acceptor materials for colored inks currently available, however, suffer from rapid fading of one or more of the dyestuffs upon exposure to light. Furthermore, currently available ink acceptor materials can be degraded easily by repeated handling or contact with moist objects. As a consequence of such contact, the moist object often becomes stained with the dyestuffs. Also, because the usual aqueous ink jet inks have relatively low volatility, imaged acceptor materials are typically still wet with the aqueous ink vehicle when emerging from an ink jet printer. Images are then most vulnerable and can be altered by smudging or blocking (print stacking). Thus, there is a need for an ink acceptor material capable of rendering ink jet images which dry rapidly, are water-resistant and light stable, can be handled and stacked without damage to the printing or images, and which have good layer clarity and good sheet feeding properties in ink jet printers. The materials of the invention meet these needs.

SUMMARY OF THE INVENTION

The acceptor materials of the invention are useful as receivers for thermal ink jet printing (bubble jet) or for non-thermal printing. In general, they are useful in any process for recording information or images with inks comprising aqueous vehicles and ionic, water-soluble, colored dyes, such as inks disclosed in U.S. Pat. Nos. 5,180,425 and 5,183,502 which are incorporated herein by reference. With such inks, of which the dyestuffs typically contain anionic groups such as carboxyl and/or sulfonate groups, the acceptor materials of the invention can provide images of high quality, which are resistant to smearing and have excellent light stability. The ink acceptor materials of the invention are especially characterized by rapid drying, a quality of major importance in ink jet printing because of the high liquid content of the ink composition, and have excellent clarity and sheet feeding properties.

Acceptor materials of the invention function by independent management of the ionic ink jet dyestuffs and the aqueous ink vehicle. A water-soluble mordant material reacts with and immobilizes the dyestuffs by forming a water-insoluble compound or coacervate while a hydrophilic, water-absorbing, solid polymer simultaneously wicks away the ink vehicle from the surface of the acceptor material. The mordant thereby controls the dye deposition and directs the dye movement (locus of dots) within the acceptor material to provide dot separation and coalescence-registration, thus maximizing the close-packing and permanence of the dyestuffs. The water-absorbent polymer having spherical, non-porous polymer beads dispersed therein controls the large volume of aqueous ink vehicle (for most aqueous inks, 70–90% of the composition) thus causing a rapid dry-to-the-touch response of the acceptor material with minimal dot beading, spreading and no blocking or smudging of the image. The spherical, non-porous polymer beads distributed at or near the ink-accepting surface of the material and protruding therefrom contribute to rapid drying and good sheet feeding while retaining optical clarity of the material. The result is a rapidly dried, full color ink jet image having excellent chroma and image resolution and stability and desirable surface properties.

The invention includes an acceptor material for inks that contain an ionic dye and an aqueous liquid vehicle. Said acceptor material comprises a support and coated on the support, an ink-accepting composition comprising (a) a water-soluble mordant compound which, when admixed in excess with said ionic dye in aqueous solution at room temperature, forms a water-insoluble precipitate and a clear substantially colorless supernatant liquid, (b) a water-absorbing, solid polymer, wherein said polymer has been rendered insoluble in water at room temperature by chemical hardening of said polymer at elevated temperature in an aqueous coating composition before coating it on said support and wherein said polymer is non-reactive with and permeable by said ionic dyestuffs and (c) non-porous, clear, substantially spherical, polymer beads dispersed in said water-absorbing polymer in an uppermost layer of said ink-accepting composition, said beads having a specific gravity no greater than that of said aqueous coating composition, said beads having diameters from about 3 to 15 μm and the concentration of said beads in said uppermost layer being from about 0.5 to 4 percent by weight based on the weight of said water-absorbing polymer in said layer.

The invention also includes the novel composition for forming an ink receiving layer on a support, the composition comprising water, a water-soluble mordant capable of forming a water-insoluble coacervate with ionic dyes, a hydrophilic hardenable polymer and a hardening agent in an amount sufficient to harden said polymer at elevated temperature and render said polymer water insoluble but water absorbent at room temperature.

The invention further includes a novel imaged ink jet acceptor sheet which comprises a support and, on said support, a layer containing hardened gelatin and, dispersed therein, a water insoluble coacervate of a water-soluble mordant compound and a water-soluble dye compound. In a preferred embodiment, suitable for outdoor display, a transparent, water-absorbing layer of hardened gelatin is coated over the layer containing said coacervate.

In addition, the invention includes a method for making an acceptor sheet for inks containing an ionic dye which comprises:

a) heating an aqueous solution comprising a hardenable polymer, water; and a chemical hardening agent;

b) maintaining said heating for a time sufficient to react said chemical hardening agent with said hardenable polymer to form a coating composition;

c) adding to said aqueous solution or to said coating composition (i) a water-soluble mordant which, when admixed in excess with said ionic dye in aqueous solution at room temperature, forms a water-insoluble precipitate and a clear, substantially colorless supernatant liquid, and (ii) non-porous polymer beads of 3 to 15 μm diameter and having a specific gravity not substantially greater than that of said coating composition; and d) coating the resulting aqueous composition on a support.

DETAILED DESCRIPTION OF THE INVENTION

Figure 1:
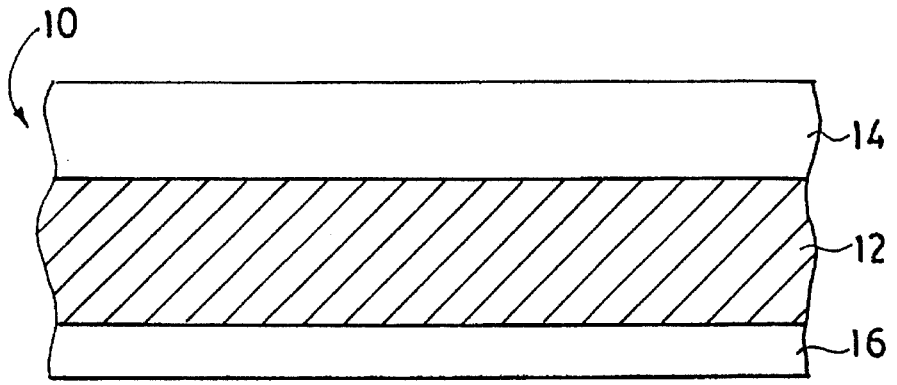
FIG. 1 shows a cross-section of an ink acceptor sheet of the invention in which the support is coated on one side with the ink accepting composition and on the other side with antistatic, curl control, or other functional layer.

The ink acceptor material of the invention provides diffusion management of the deposited wet ink dots, the dyestuffs therein, and the liquid vehicle of the soluble dyes. Surprisingly, the applicants have found that polymers, such as those mentioned hereinafter, when subjected to chemical hardening prior to coating perform the role of absorbing the ink droplets and providing a strong, durable, non-tacky, three-dimensional matrix for the dyestuff immobilizing component of the material, i.e., the water-soluble mordant. The polymers employed are hydrophilic and easily swellable by the aqueous vehicle of the inks to wick away quickly said vehicle from the surface of the material, whereby the surface of the acceptor material dries rapidly. Said polymers are transparent and can yield, if desired, a finished surface of high gloss. The solid wicking or water-absorbing polymer is rendered insoluble in the ink vehicle below 50° C. by chemical hardening of the polymer in an aqueous medium at elevated temperature prior to coating of the composition on its support. The hardened polymer is, however, soluble in the aqueous medium at elevated temperature above 50° C. and the composition therefore remains coatable.

The ink acceptor materials of the invention are prepared by coating and drying on a transparent, translucent or opaque sheet or web a layer or layers of the appropriate compositions. In one embodiment an aqueous coating composition is formed which contains the water-absorbing polymer, a hardening agent, the mordant and non-porous polymeric beads. In addition, the composition preferably contains a coating aid. The coated layer is dried to form a thin layer in which the mordant is uniformly distributed throughout the water-absorbing polymer matrix and the polymeric beads protrude from the surface of the layer. The total thickness of the dried ink receiving composition on the support, whether coated as one or a plurality of layers, is preferably in the range from about 1 to 25 μm, (although greater thicknesses can be used), and, most preferably, is in the range from about 2 to 18 μm.

The water-absorbing polymers employed in the materials of the invention have no affinity for the water-soluble ink jet dyes and therefore allow rapid diffusion of said dyes into the ink acceptor material, wherein said dyes are very rapidly immobilized by chemical reaction with a mordant to form a non-diffusing compound or coacervate. The mordant can be distributed uniformly throughout the water-absorbing polymeric matrix or it can be mixed with a portion of the water-absorbing polymer and coated in a separate layer above or below the water absorbing layer. When the mordant compound is cationic it forms an ionic bond with water-soluble counterionic dye compounds such as those disclosed in U.S. Pat. Nos. 5,180,425 and 5,183,502 cited above. The high optical density which characterizes the images formed by the acceptor materials of the invention appears to result from the high concentration of mordanted dye or coacervate at the exposed surface of the mordant, regardless of its coated placement relative to the support.

Although the ink jet inks with which the ink accepting materials of the invention provide such outstanding results, are aqueous inks, it should be understood that, in addition to water, the ink vehicle can also include hydrophilic organic liquids. In general, the water content of the aqueous vehicle of the inks is in the range from about 30 to 99 weight percent, and preferably 70 to 90 weight percent, the rest being hydrophilic organic liquids such as glycols, glycol ethers, pyrolidones and surfactants. As is known, such hydrophilic liquids can aid in the delivery of the inks by ink jet printers.

Referring to the drawings, FIG. 1 shows a preferred embodiment 10 of an acceptor material of the invention comprising support 12 and, coated on it, ink accepting composition 14. Support 12 is a sheet material which can be transparent, translucent, or opaque. Useful transparent or translucent materials include, for example, poly(ethylene terephthalate), cellulose acetate, polycarbonate, polyolefin, polyvinyl chloride, polystyrene, polysulfone, styrene acrylonitrile (also known as SAN), glass and the like. Useful opaque sheet materials include paper, opaque filled polyester, polyethylene-clad paper, white polypropylene film and the like. Support 12 can be coated with a conventional tie or subbing layer (not shown) to enhance adhesion of composition 14 to support 12, as well as one or more backing layers 16 to control conditions such as static, blocking, curl or color.

Ink accepting composition 14 comprises a water-absorbing polymer, which has been hardened in solution prior to coating by reaction with a hardening agent. Upon being coated and dried, the polymer forms a matrix which is transparent to light, is insoluble in water at room temperature, and is resistant to abrasion. The polymer, however, retains its hydrophilic character, is easily swollen by water, is easily permeated by the aqueous ink vehicle and by water soluble dyestuffs, and has no chemical affinity for said dyestuffs. The hardened polymers used in the acceptor materials of the invention are water-absorbing polymers that are so easily swollen by water that they are swellable by up to 400% when immersed in the aqueous ink vehicle. By this is meant that the volume of the polymer increases by at least about 400% when soaked in water.

A highly preferred hardenable polymer is gelatin. Other preferred polymers include chitosan (discussed more fully hereinafter) and 100 percent hydrolyzed poly(vinyl alcohol). Hardenable natural polymers other than gelatin and chitosan that can be used in the materials of the invention include starch, agarose, albumen, casein, and gum arabic. Hardenable synthetic materials include, for example, hydroxy propyl cellulose (e.g., Klucel polymer of Hercules Corp.), carboxylated styrenebutadiene lattices, poly(acrylic acid), poly(methylvinylether-co-maleic anhydride), e.g., Gantrez 169 polymer, poly(vinyl alcohol) and poly(N-vinyl-4-pyrrolidone).

Still another prehardened polymer which is useful as the water-absorbing polymer in the ink-accepting materials of the invention is hardened chitosan. Chitosan is partially deacetylated chitin. Commercially, chitin is extracted from shrimp and crab shells and transformed to chitosan to obtain a water-soluble product. Chitosan is a linear biopolymer, specifically a polysaccharide which comprises two monosaccharides, N-acetyl-D-glucosamine and D-glucosamine linked by $\beta(1\rightarrow4)$ glycosidic bonds. Commercial chitosans have degrees of deacetylation between 75 and 95 percent. The viscosity range of commercial chitosans is from 10 to 1000 mPa's. A chitosan useful in preparing the materials of the invention is available from Pronova Biopolymer a.s. of Drammen, Norway. The chitosan is prehardened, by heating in aqueous solution with a chemical hardening agent such as disclosed herein, for use in the materials of the invention.

As discussed in more detail hereinafter, composition 14 also has dispersed therein, and predominantly at the surface thereof, certain non-porous polymeric beads. These beads provide valuable surface properties while contributing to ink absorption, but retain the desired clarity of the layers of the ink-accepting material of the invention.

Composition 14 further includes a water-soluble mordant or dye-fixing agent, which is capable of bonding ionically or otherwise with the dyestuffs in ink jet inks, to form a water-insoluble, immobile or "coacervate" compound in the acceptor matrix without any significant change in the chroma or hue of the original dyestuffs. By water-soluble mordant is meant a mordanting compound capable of dissolving in water at room temperature (20° C.) to at least a 10 gm/liter concentration. Preferably, the mordant is water-soluble to at least 30 gm/liter at room temperature.

Different types of water soluble mordants are useful in the practice of the invention. Certain compounds that are useful mordants in the materials of the invention immobilize or anchor the anionic dyestuffs of ink jet aqueous inks by forming ionic bonds with the dyes. Others bond to the dyes by mechanisms that are not fully understood. They all have in common, however, the fact that, when tested in the screening tests described hereinafter, they rapidly form insoluble precipitates with the dye when mixed therewith in aqueous solution at room temperature. One useful type of mordant that forms ionic bonds with the anionic dyes is a water-soluble, cationic polymer having quaternary ammonium side chains such as, for example, diethylammonium chloride hydroxyethyl cellulose (available as Celquat L-200 and Celquat H-100 from National Starch and Chemical Company). Both of the latter are cationic cellulosic polymers; Celquat H-100 has a viscosity of approximately 600 (2% solids in water; RVF Brookfield Viscometer, #2 Spindle/20 RPM/21° C.) and Celquat L-200 has a viscosity of approximately 100 cps. Another useful mordant that forms ionic bonds is a copolymer of dimethyldiallyl ammonium chloride (available as FlocAid 19 from National Starch and Chemical Company). Still another useful mordant of this type comprises a metal ion from the electropositive side of the periodic table of elements, preferably, ions of Group II metals such as divalent barium, strontium, or calcium. The metal ions are incorporated in the materials of the invention by mixing an aqueous solution of a salt of the metal, e.g., $BaCl_2$, $SrBr_2$ or $CaCl_2$, with the wicking material during formulation of the coating composition.

Useful mordant compounds which pass the screening test but which anchor the anionic dyestuffs by mechanisms that are not understood include non-ionic and high molecular weight (i.e., at least about 400 m.w.) amino compounds. They can be primary, secondary or tertiary amines. These include water-soluble, non-ionic polymers containing amino groups, for example, poly(4-vinylpyridine) which is available from Monomer Polymer Company. Other examples include the propylene oxide based triamines of the Jeffamine T series which are available from Texaco, Inc. They are prepared by the reaction of propylene oxide with an aliphatic triol initiator having up to about 12 carbon atoms, such as trimethylolpropane or glycerine, followed by amination of the terminal hydroxyl groups. These tri-primary amines are exemplified by the structure:

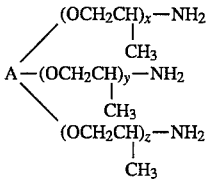

wherein A is the initiator moiety. Molecular weights range from about 440 to about 5000. x, y and z are each positive integers and x+y+z=3 to about 85. Further discussion of such amino compound mordants appears in the concurrently filed patent application of Ronald F. Lambert entitled "Ink Acceptor Material Containing an Amino Compound", incorporated herein by reference.

Other compounds which pass the screening test and are useful as water-soluble mordants in the materials of the invention, but which anchor the anionic dyes by a mechanism that is not understood, are high molecular weight phospholipids such as lecithin and the phospholipid EFA, phospholipid SV and phospholipid PTC which are available from Mona Industries, Inc. The latter phospholipids have the structure:

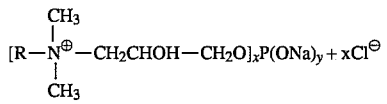

where x plus y=3. In such phospholipids R is a saturated or unsaturated long chain carboxylic acid (e.g., of 14 to 22 carbon atoms) amido alkyl (e.g., of 2 to 6 alkyl carbon atoms) radical. In phospholipid EFA, R is linoleamidopropyl; in phospholipid SV, R is stearamidopropyl and in phospholipid PTC, R is cocamidopropyl. Further discussion of such phospholipid mordants appears in the concurrently filed patent application of Ronald F. Lambert entitled "Ink Acceptor Material Containing a Phospholipid", incorporated herein by reference.

All of the described types of water-soluble mordants which pass the screening test A below are suitable for bonding to, and immobilizing in the matrix, the anionic dyestuffs of ink jet inks. The selection of suitable mordants can be facilitated by the simple screening test in which an aqueous solution of an anionic dyestuff which is present in the aqueous ink jet ink is added at room temperature (20° C.) to an aqueous solution of the mordant. The rapid formation of a coacervate or precipitate, which can be an oil or a solid, and a clear, substantially colorless supernatant liquid indicates the suitability of the mordant for use in the ink acceptor materials of the invention. The screening procedure is illustrated as follows:

Coacervation Screening Test A

Add Dyestuff to Mordant Solution

Polymeric Quaternary Ammonium Salt Test:

1000 picoliters of 5% magenta dyestuff in water is added at room temperature to 20 mg of FlocAid 19 polymeric quaternary ammonium salt in water. A gelatinous red precipitate forms. The supernatant liquid is clear and colorless.

Poly(N-vinyl-4-pyrrolidone) Test:

In the same manner the magenta dyestuff solution is added to an aqueous solution of poly(N-vinyl-4-pyrrolidone). No precipitate forms and the liquid is colored.

As shown above, the quaternary ammonium polymer (FlocAid 19) passes the screening test A as a useful mordant but poly (N-vinyl-4-pyrrolidone) does not.

Test A is the preferred method for selecting and defining the types of compound that are useful as mordants in the acceptor materials of the invention. In this test, the mordant candidate is in a molar excess. The suitability of the mordant is demonstrated by the rapid formation of a precipitate and by the fact that the supernatant liquid remains clear and substantially uncolored, thus showing that substantially all of the dye has been mordanted or converted to the insoluble precipate or coacervate.

Test B below is another possible screening test for mordants. In this test an aqueous solution of the candidate mordant is added to an aqueous solution of the ink jet anionic dyestuff with which images are to be formed. Since the dyestuff is in excess, the supernatant liquid is colored. If the mordant candidate is suitable, it either forms a precipitate immediately or at least forms immediately a turbid suspension which can be centrifuged to obtain a precipitate. Thus either Test A or Test B can be used but Test A is preferred as a method for defining the suitable mordants because Test A shows that the dye reacts quickly with the mordant and substantially none is in solution in the supernatant liquid.

Coacervation Screening Test B

Add Mordant to Dyestuff Solution

Polymeric Quaternary Ammonium Salt Test:

To one ml of 5% magenta dyestuff aqueous solution is added 1000 picoliters of a 5% aqueous solution of FlocAid 19 polymeric quaternary ammonium salt. A heavy precipitate forms immediately.

Poly(N-vinyl-4-pyrrolidone) Test:

In the same manner an aqueous solution of poly(N-vinyl-4-pyrrolidone) is added to the aqueous solution of dyestuff. No insolubilization reaction occurs.

Test B shows the rapid formation of a water-insoluble coacervate when a polymeric quaternary ammonium salt (Floc-Aid 19) is mixed with the water-soluble, anionic magenta dyestuff solution in excess and shows that this compound is suitable as a mordant in the ink acceptor materials of the invention. Poly(N-vinyl-4-pyrrolidone), however, forms no insoluble coacervate with the dyestuff and would not be selected as a mordant component of the materials of the invention.

The ink-accepting materials of the invention, in addition, to the prehardened water-absorbing polymer and water-soluble mordant, contain certain surface-modifying, polymeric particles which, in combination with the prehardened polymer and the water-soluble mordant, provide an ink-accepting material having a number of unexpectedly superior properties. These properties include, not only rapid water-absorption and dye retention, but also a desired degree of surface roughness, a low coefficient of friction and a porous surface which contributes to short drying time. These desirable properties are achieved by incorporating in the coating composition that forms the surface of the ink-accepting material, clear, non-porous polymer beads, preferably substantially spherical beads, having diameters in the range from about 3 to 15 μm and, preferably, 6 to 13 μm. In addition, the beads have a specific gravity not substantially greater than that of the coating composition. Especially preferred are beads of poly(methyl methacrylate) and poly(dimethylsiloxane) having specific gravities in the range from about 0.4 to 1.2.

Examples of such beads include the clear transparent, spherical polymer beads of 9–13 μm diameter which are available from Esprit Chemical Company as Soken MR13 beads. The polymer is a crosslinked poly(methyl methacrylate) of which the monomers are 97 wt. % methyl methacrylate and 3 wt. % ethylene glycol dimethacrylate. Another example is the GE SR346 bead product of General Electric Company. This product consists of poly(dimethyl siloxane) spherical beads of 7 to 12 μm diameter.

In accordance with the invention, the applicants have found that the addition of such polymer beads to the surface layer containing a prehardened water-absorbing polymer improves the water-absorption of the acceptor material, reduces or eliminates multifeed jams and other problems in the feeding of sheets of the acceptor material in printing apparatus, and reduces or eliminates the blocking and image offset of stacked sheets. Unexpectedly, the incorporation of the described organic polymer beads in the surface layer of the materials of the invention does not impair the transmission clarity of the ink-accepting material. Thus, the materials of the invention are quick drying, form water-resistant and light stable images, have excellent transmission clarity, and excellent sheet feeding and handling properties.

Although applicants again do not wish to be bound by theoretical explanations, it appears that the organic polymeric particles or beads of low specific gravity and of 3 to 15 μm diameter are predominantly at or near the surface of the coated layer in which they are incorporated. Because of their low specific gravity they do not settle to the lowest level of the coated layer. Being at or near the top of the layer and being of appropriate particle size, a substantial portion thereof protrudes from the surface of the layer. This results in the desired surface roughness. Since the particles are substantially spherical polymer beads, the surface also has a low coefficient of friction. In addition, the beads contribute to excellent water absorptivity by the ink-accepting material. Preferably, also the beads are formed of a polymer such as poly(methyl methacrylate) or poly(dimethyl siloxane) which has a refractive index close to that of the hardened water-absorbing polymer and thus the transmission clarity of the layer is substantially retained.

The surface roughness of the materials of the invention can be expressed in terms of a BEKK smoothness measurement. This well-known definition of smoothness is measured by means of a BEKK Smoothness and Porosity Tester which is supplied by Büchel-Vander Korput Nederland BV of Veenendaal, Holland. The measurements are expressed in reciprocal seconds. The BEKK smoothness of the materials of the invention is in the range from about 5 to 60 $sec^{-1}$ and, preferably, is in the range from 10 to 40 $sec^{-1}$. The static coefficient of friction is less than about 0.45 and preferably less than 0.35. The kinetic coefficient of friction is less than about 0.350 and, preferably, is less than about 0.300. Coefficients of friction are measured with a TMI coefficient of friction instrument. These levels of roughness and of coefficient of friction can be achieved by incorporating in the coating composition for the uppermost or surface layer of the material of the invention approximately 0.5 to 4 weight percent on dry basis of substantially spherical polymer beads of 3 to 15 μm diameter. Preferably, the concentration of beads in the uppermost layer of the ink-accepting composition is in the range from about 1.5 to 4 weight percent based on the amount of water-absorbing polymer in the layer.

In one embodiment of the invention the BEKK smoothness of the surface is 38 $sec^{-1}$ as compared with >1000 $sec^{-1}$ for an otherwise identical control material but which contains no polymer beads. For that same embodiment the static and kinetic coefficients of friction are 0.328 and 0.282, respectively, and for the control are >1.0 and 0.560, respectively.

The effect of the beads on transmission clarity of the materials of the invention can be expressed in terms of percentage of reduction or loss of transmission density as compared with an otherwise identical control which contains no beads and is less than about 0.04 density units. Thus, although the non-porous polymeric particles roughen the surface of the material and convert the normally non-porous, smooth surface of the hardened polymer to a porous condition, they do not substantially impair the transmission clarity of the layer.

Transmission clarity of the materials of the invention can be measured by laminating ten strips of the film with a coating of glycerine on each surface to match the refractive index of the film at the air interfaces and measuring the transmission density. By this test the control, having no beads in its surface layer, measures 0.04 transmission density and the material of the invention is substantially as clear, i.e., measuring 0.06. Thus, the addition of the polymer beads to the surface layer does not substantially reduce or impair its transmission clarity. As for drying time, the control requires more than two minutes to dry a large area of black ink (1 $in.^2$) while the material of the invention with the same area of black ink requires only 45 seconds.

Surface gloss of the acceptor materials of the invention can be controlled by choice of mordant. Applicants have found that use of the polymeric quaternary ammonium mordant, Celquat L-200, with hardened gelatin as the water-absorbing material, results in a matte surface material having low gloss and excellent tooth for manual pencil or ink pen marking. In contrast, acceptor materials of the invention having high gloss (which is desirable for image quality) are obtained when the mordant is the non-ionic amino compound, poly(4-vinylpyridine), or is a phospholipid such as phospholipid EFA. Surprisingly, the addition of polymer beads to the surface layer does not substantially reduce the gloss of such glossy materials.

The acceptor material of the invention accepts the ink dots cleanly and allows sufficient coalescence time to achieve good dot registration, yet permits penetration of the inks to achieve proper hue and chroma without beading. At the moment of contact, the ink vehicle begins to diffuse into the acceptor layer, increasing the concentration of dyestuff in the applied droplets on the acceptor material surface. The ionic colored dyes also begin to diffuse into the material where they are captured and bound irreversibly by the mordant as a coacervate which in the single layer embodiment is distributed uniformly throughout the coated layer. This coacervate formation causes each colored dye dot to be fixed in registration with good edge definition onto the mordant functional sites, and the image quality is thus preserved. Also, the high local concentration of dyestuff results in a high chroma (or color saturation) and efficient packing density of the dye dots.

The aqueous vehicle for the ink dyes is wicked away from the porous, uppermost surface rapidly by the hydrophilic, water-absorbing polymer of the acceptor material. In effect, the coated layer appears to perform a chromatographic separation of the ink composition, evidently retaining the dyes on the active mordant surface sites while 5permitting the liquid vehicle to diffuse readily to the unswelled portion of the polymer. This combination of actions results in high chroma, good light stability, water fastness, and short drying times. For all but a very large black image area, the inks are dry to the touch as the print emerges from a thermal ink jet primer such as the "500 or 550 C Desk Jet" printer of the Hewlett-Packard Company and the BJC600 Color Bubble Jet primer of Canon Company. Large black areas (50% page coverage) become dry within 45 seconds.

The acceptor materials of the invention are capable of absorbing and wicking away rapidly all the aqueous vehicle of the inks and dispersing the liquid throughout the water-absorbing polymer, leaving the surface of the acceptor material dry to the touch. The water-absorbing polymer swells by up to 400% in so doing, but then remains water-insoluble at room temperature because of the high degree of hardening pre-treatment.

Figure 2:
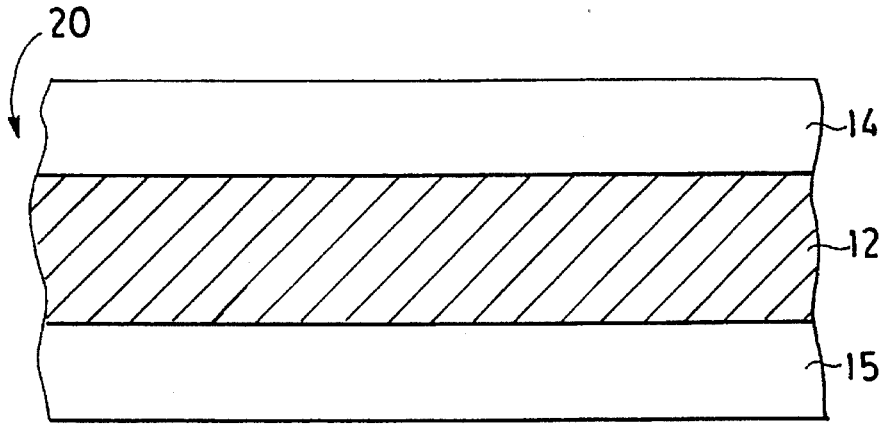
FIG. 2 shows a cross-section of an ink acceptor sheet of the invention in which the support is coated on two sides with ink accepting compositions.

FIG. 2 shows another embodiment 20 of the invention wherein support 12 is coated on both sides with ink accepting compositions 14 and 15, which can be the same or different and which can be coated to the same or different thicknesses. The embodiments of FIGS. 1 and 2 can further include one or more protective overcoats in which the polymer beads are dispersed (not shown) on top of ink-accepting layers 14 and 15.

Figure 3:
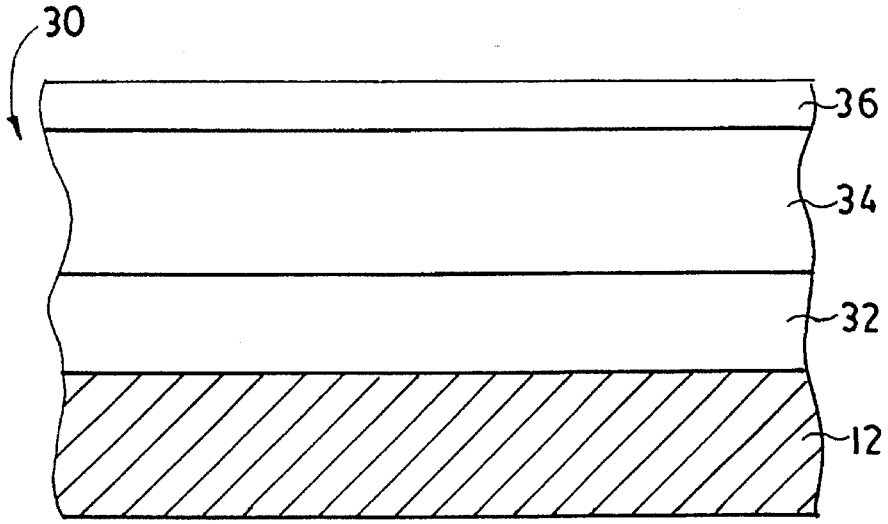
FIG. 3 shows a cross-section of an acceptor sheet of the invention in which the support is coated on one side with a dye mordanting layer, a liquid-absorbing layer, and an overcoat layer.

FIG. 3 shows still another embodiment 30 of the invention wherein an image-forming layer 32 containing the mordant compound and a portion of the water-absorbing polymer is coated on support 12. Coated over layer 32 is transparent water-absorbing polymer layer 34 which is substantially free of said mordant, but contains non-porous polymeric beads (not shown) which roughen the surface of the water-absorbing polymer layer and render it semi-porous. The hardened, transparent polymer of the water-absorbing, wicking layer 34 has no affinity for the ionic dyestuffs of the ink jet inks, which are captured completely and irreversibly by the mordant material in layer 32. This embodiment is suitable for outdoor display and for other uses when a high degree of protection for the image-forming layer is desired, since the image layer is well below the upper surface of the film. If desired, the embodiment of FIG. 3 can be further protected by a transparent polymeric overcoat 36, in which case the polymeric beads are dispersed in the overcoat 36.

Figure 4:
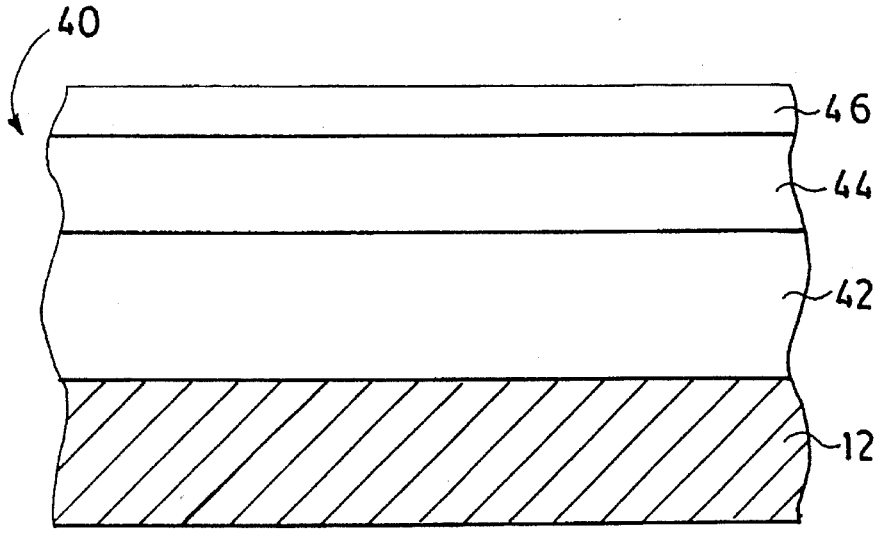
FIG. 4 shows a cross-section of another plural layer embodiment of the acceptor sheet of the invention.

FIG. 4 shows still another embodiment 40 of the invention wherein an image-forming, mordant layer 44 is coated over the water-absorbing polymer of wicking layer 42. As in embodiment 30, a protective overcoat 46 may or may not be present. Embodiment 40 can be useful when the maximum possible image definition is desired, since the dyestuffs are captured near to the upper surface of the acceptor material before substantial diffusion of the imaging dots can occur.

An important aspect of the invention is the chemical hardening of the matrix-forming polymer in the making kettle prior to coating. In this way, a higher level of control of hardening is obtained than could be achieved by addition of hardening agent to the coating machine delivery line as is conventional in, for example, the manufacture of photographic products using gelatin. Furthermore, no post-hardening or incubation of the coated acceptor material is required.

Kettle prehardening is accomplished by adding the hardening agent to the polymer solution at elevated temperature, e.g., 49° C. (120° F.), and then maintaining that solution temperature until all the agent is consumed in cross-linking of the polymer. The reaction is accompanied by a characteristic rapid increase in viscosity to a substantially higher but coatable viscosity. The reaction is deemed at equilibrium and therefore complete when no further viscosity increase is seen after holding the composition at the indicated elevated temperature for 15 hours.

The particular hardening agent to be used can vary according to the composition of the polymer to be hardened. For gelatin, a preferred hardener is dimethyl hydantoin. Various aldehydes, e.g., formaldehyde, glutaraldehyde and succinaldehyde are also useful. Other useful gelatin hardeners are disclosed, in "The Theory of the Photographic Process," Macmillan Publishing Co., Inc., New York, Fourth Edition, T. H. James, Editor; (see Chapter III, pages 77–87, by Burness and Pouradier, entitled "The Hardening of Gelatin and Emulsions"), the disclosure of which is incorporated herein by reference. For 100 percent hydrolyzed poly(vinyl alcohol) preferred hardeners are boric acid and urea-formaldehyde resins. Hardening agents for other polymers include, for example, the trifunctional aziridine, trimethylol propane tris (β-aziridinyl) propionate, known as XAMA-7 which is available from Sanncor Co. The amount of hardening agent in the composition of the invention can vary over a considerable range. In general, however, the amount should be sufficient to render the polymer insoluble in water at temperatures below 50° C. while retaining water solubility at temperatures above about 50° C., so that the ink accepting composition of the invention can be coated on a support from an aqueous medium. In general, the desired amount of hardening agent can be determined by the equilibrium viscosity achieved by adding the agent. Sufficient hardening agent is added to increase the viscosity of the aqueous polymer coating composition from about 10 to 200% at a given solids concentration but not so much as to render it uncoatable. Preferred weight ratios of hardening agent to gelatin are in the range from about 1:1 to 1:10 although other ratios are also suitable. Other hardenable polymers can be hardened with similar ratios of hardening agent.

To prepare the composition of the invention for coating as a single layer on a support, preferably, the hardenable water-absorbing polymer, the hardening agent, the water soluble mordant, the polymer beads and water are mixed together in a vessel with stirring and moderate heating. If desired, the polymer and hardener can be mixed before adding the mordant and beads but it can be advantageous to add the mordant before the polymer is hardened. This can have the effect of grafting the soluble mordant compound to the wicking polymer. Other desirable components of the coating composition such as coating aid can be added before or after hardening the matrix polymer.

Conventional coating techniques can be used for producing the coated ink acceptor materials of the invention, including, for example, spray coating, bar coating, extrusion die coating, air knife, knife over roll coating, reverse roll, curtain coating, blade coating and gravure coating of a continuous web of the support material. The coated web is dried in conventional manner e.g., by contact with warm air while passing through a drying chamber. The total thickness of the dried ink-accepting composition on the support, whether coated as one or a plurality of layers, is preferably in the range from about 1 to 25 μm, (although greater thicknesses can be used) and, most preferably, is in the range from about 2 to 18 μm. The dried coated web can be wound on a take-up roll and later cut to desired sheet sizes.

The coated amount of water-absorbing polymer must be sufficient to absorb the substantial volume of water that is present in the ink jet droplets. In general, an amount of water-absorbing polymer of at least about 2.0 grams per square meter on the support will adequately absorb the water in the ink jet droplets and will provide a quick-drying material. Likewise, the ink accepting composition must contain a sufficient amount of mordant to bind all of the dyestuff in the ink. In general, the amount of mordant should be at least about 0.5 weight percent and, preferably, at least 5 weight percent, of the amount of dry water-absorbing polymer in the ink accepting composition. The maximum mordant content should not be so high as to impair the desired physical properties of the acceptor material. Preferably, the mordant concentration does not exceed about 30 weight percent based on the weight of the water-absorbing polymer.

The examples which follow illustrate certain specific embodiments of the invention and describe comparative tests with commercially available ink jet acceptor materials.

EXAMPLE 1

Hardened Gelatin and Polymeric Quaternary Ammonium Mordant

A batch of solution was prepared for coating in accordance with the invention. A vessel fitted with a mixer and a heater was charged with 93 grams of 10% suspension of gelatin in water (available as T7188 from K&K Corp.) and 50 grams of distilled water. The mixture was stirred and the temperature was raised to 49° C. (120° F.). After 5 minutes of stirring, the viscosity was 23 cps. Then 1.72 grams of a 55% aqueous solution of dimethyl hydantoin (Dantoin hardener, available from Lonza Co.) was added with continued stirring. After 10 minutes, the viscosity had increased to 35 cps, and no further increase was seen. Then was added as the mordant, 2.30 grams of aqueous solution of a polymeric quaternary ammonium compound (FlocAid 19 from National Starch and Chemical Co.) with stirring, followed by 0.23 grams of cross-linked poly(methylmethacrylate) beads, 9–13 μm in diameter (Soken MR-13G beads available from Esprit Chemical Co.) and 2.79 grams of 2% aqueous solution of octylphenoxypolyethoxy-ethanol (Triton X-100 available from Union Carbide) as coating aid. The temperature was reduced to 38° C. (100° F.), and the resulting thickened solution was ready for coating.

The thickened solution was coated on transparent 98 μm thick (3.85-mil) poly(ethylene terephthalate) film and dried to provide a dry coverage of 9 grams per square meter of support, resulting in a dried ink-accepting layer having a thickness of 9 μm. When this film was imaged on a Hewlett-Packard 500C DeskJet ink jet printer using a cartridge of Hewlett-Packard ink containing ionic dyes, the individual ink images emerged dry from the printer. Dot resolution was excellent.

To test water resistance of the printed dyes, a strip of the printed film was immersed in water for two minutes, then removed and dried. Reflection dye densities of immersed and non-immersed strips were measured with an X-Rite Reflection Densitometer, Model 408. The results of these measurements are listed in Table I and demonstrate the water-fastness of the ink acceptor film of Example 1:

TABLE I

| | Water-Fastness Test of Example 1 Film | | |
|---|---|---|---|
| Dye | Optical Density Before Immersion | Optical Density After Immersion | Density Difference Between Non-Immersed and Immersed Films |
| Cyan | 1.42 | 1.54 | +.12 |
| Magenta | 0.96 | 1.00 | +.04 |
| Yellow | 0.86 | 0.89 | +.03 |
| Black | 1.60 | 1.66 | +.06 |

The results recorded in Table I show that immersion of the imaged film of the invention in water caused no density loss, thus indicating that essentially none of the mordanted dye was washed from the film. The increases in density shown for certain of the dyes are believed to have resulted from swelling and possible dye rearrangement and repacking. In comparison, a commercial ink jet acceptor film when printed and subjected to the same water-immersion test showed a magenta dye density change of –0.77.

Light Exposure Testing of Example 1 Film of the Invention and a Commercial Film Example 1 film of the invention and a commercially available ink jet recording film which were identically imaged in an ink jet printer were exposed to GE F400W fluorescent bulbs at 5,000 lux intensity for 72 hours, at the end of which time they were compared to otherwise identical unexposed strips (ASTM F767-82) of the same imaged films. The reflection densities (indicating dye light stability) are shown in Table II for the Example 1 film and for the commercial film.

TABLE 11

| | Comparison of Light Exposure Results of Example 1 Film of the Invention and Commercial Film | | | |
|---|---|---|---|---|
| Dye | Density of Non-Exposed Film of Example 1 | Density of Exposed Film of Example 1 | Density Difference Between Non-Exposed and Exposed Film of Example 1 | Density Difference Between Non-Exposed and Exposed Commercial Film |
| Cyan | 1.42 | 1.27 | –0.15 | –0.89 |
| Magenta | 0.96 | 0.94 | –0.02 | –0.02 |
| Yellow | 0.86 | 0.80 | –0.06 | –0.17 |
| Black | 1.60 | 1.50 | –0.10 | –0.38 |

The next example describes a product of the invention in which the mordant is another polymeric quaternary ammonium compound.

EXAMPLE 2

Hardened Gelatin and Polymeric Quaternary Ammonium Mordant

In this example the mordant was the polymeric quaternary ammonium compound, Celquat H 100 compound. The mordant and wicking polymer, namely, prehardened gelatin, were included in the same layer. The coating composition was prepared as in Example 1 from the components as follows:

| | |
|---|---|
| 20.0 grams | 10% gelatin |
| 0.37 grams | 55% Dantoin hardening agent |
| 6.0 grams | 2.5% Celquat H100 mordant |
| 0.06 grams | 2% Triton TX-100 coating aid |
| 0.05 grams | Soken MR-13G poly(methyl methacrylate) beads (9–13 μm) |
| 73.52 grams | Water |

The solution was coated on a transparent polyester film support at a concentration of 9 grams per square meter and dried. After printing with colored aqueous inks in an ink jet thermal printer the resulting image was tested and compared with a commercial film for water-immersion stability and light stability of the dyes as previously described. After water immersion for two minutes the Example 2 film of the invention had a magenta dye density loss of only –0.03 while the commercial film decreased in magenta density by −0.77 units. The results of the light exposure test are listed in Table III.

TABLE III

Comparison of Light Exposure Results of Example 2 Film of the Invention and Commercial Film

| Dye | Film of Example 2 Before Exposure | Film of Example 2 After Exposure | Density Difference Between Unexposed and Exposed Film of Example 2 | Density Difference Between Unexposed and Exposed Commercial Film |
|---|---|---|---|---|
| Cyan | 1.36 | 1.08 | −0.28 | −0.59 |
| Magenta | 0.94 | 0.90 | −0.04 | −0.06 |
| Yellow | 0.53 | 0.51 | −0.02 | −0.11 |
| Black | 1.59 | 1.46 | −0.13 | −0.20 |

As in the other comparative tests, Table III shows superior dye fastness after light exposure for the film of the invention containing the polymeric cationic mordant, especially with regard to cyan dye stability.

The next example describes preparation and testing of another ink acceptor material of the invention, in this case the mordant being a metallic cation, namely, barium ion.

EXAMPLE 3

Hardened Gelatin and Barium Ion Mordant

As in Example 1, a heated mixing vessel was charged with 20 g. of a 10% aqueous suspension of gelatin and the temperature was raised to 49° C. (120° F.). To the gelatin suspension was then added 0.38 g of a 55% aqueous solution of dimethyl hydantoin (Dantoin hardener). The mixture was stirred for 5 minutes to increase its viscosity and then was added 0.6 g of a 2% aqueous Triton X-100 coating aid, 0.05 g of 9–13 μm cross-linked poly(methyl methacrylate) beads (Soken MR 13G beads) and 2.0 g of 10% aqueous solution of barium chloride. The resulting ink-acceptor composition was coated on poly(ethylene terephthalate) film and dried to yield a dried coating of 2 g per square meter. The material was then printed with a magenta ink jet aqueous ink and was subjected to the water immersion test as previously described. A control film material containing no barium chloride was printed and tested in the same manner. The control showed a magenta dye density change of −0.27. The acceptor material of the invention, containing barium ion as mordant, showed a magenta dye density change of only −0.06, thus demonstrating the superior water resistance of a dye printed on the novel ink acceptor material of the invention.

The invention has been described in detail with particular reference to preferred embodiments thereof, but it will be understood that variations and modifications can be effected within the spirit and scope of the invention.

We claim:

1. An acceptor material for inks that contain an ionic dye and an aqueous vehicle, said material comprising:

a support, and coated on one side of said support (a) a water-soluble mordant which, when admixed in excess with said ionic dye in aqueous solution at room temperature, forms a water-insoluble precipitate and a clear, substantially colorless supernatant liquid, said mordant being dispersed in transparent water-absorbing solid polymer, wherein said polymer has been rendered insoluble in water at room temperature by chemical hardening of said polymer at elevated temperature in an aqueous coating solution prior to coating of said coating solution, and wherein said polymer is non-reactive with and permeable by said ionic dye, and (b) non-porous, clear, substantially spherical polymer beads dispersed in transparent water-absorbing polymer in the uppermost layer of said acceptor material, said uppermost layer being transparent, wherein said water-absorbing polymer has been rendered insoluble in water at room temperature by chemical hardening of said polymer at elevated temperature in an aqueous coating solution prior to coating of said coating solution, and the polymer of said beads has a specific gravity no greater than that of said aqueous coating solution of said hardened transparent water-absorbing polymer, said beads having diameters from about 3 to 15 and the concentration of said beads in the uppermost layer being from about 0.5 to 4 percent by weight based on the weight of said transparent water-absorbing polymer in said uppermost layer.

2. An acceptor material of claim 1 which comprises a transparent layer containing both said mordant and said transparent water-absorbing polymer and said beads being predominantly at or near the surface of said layer.

3. An acceptor material of claim 1 which comprises a transparent image-forming layer which contains said mordant dispersed in transparent water-absorbing polymer and another transparent layer which contains transparent water-absorbing polymer but substantially no mordant, said image-forming layer being located on the same side of the support above or below said layer which contains substantially no mordant.

4. An acceptor material of claim 3 which comprises said image-accepting layer coated on said support, said image-forming layer containing said mordant dispersed in transparent water-absorbing polymer, and the uppermost layer coated over said image-accepting layer, said uppermost layer comprising transparent water-absorbing polymer and polymer beads but substantially no mordant.

5. An acceptor material of claim 1 wherein said transparent water-absorbing polymer is gelatin which has been pre-hardened by chemical reaction with a hardening agent prior to coating.

6. An acceptor material of claim 5 wherein said transparent water-absorbing polymer is swellable by up to about 400% when immersed in said aqueous vehicle.

7. An acceptor material of claim 5 wherein said hardening agent is dimethyl hydantoin.

8. An acceptor material of claim 1 wherein said mordant is cationic.

9. An acceptor material of claim 8 wherein said cationic mordant comprises a polymeric quaternary ammonium compound.

10. An acceptor material of claim 8 wherein said cationic mordant comprises divalent barium ion.

11. An acceptor material of claim 3 which, when contacted by said inks, immobilizes said dye in said image-forming layer containing said mordant while permitting said aqueous vehicle to diffuse throughout said image-forming layer and said layer which contains substantially no mordant.

12. An acceptor material of claim 3 wherein said support is a transparent plastic film.

13. An acceptor material of claim 12 wherein said beads are poly(methyl methacrylate) beads or poly(dimethyl siloxane) beads of about 3 to 15 μm in diameter and the concentration of beads is in the range from about 1.5 to 4 weight percent based on the amount of transparent water-absorbing polymer.

14. An acceptor material for ink jet ink containing at least one water-soluble anionic dye and an aqueous vehicle, said material comprising a support and, coated on said support, a transparent layer of an ink-accepting composition comprising a chemically hardened gelatin matrix which is water-insoluble but water swellable and which has non-porous, spherical polymer beads dispersed therein and protruding from an upper surface of said layer, said beads having diameters from about 3 to 15 μm and the concentration of said beads in said layer being from about 0.5 to 4 percent by weight based on the weight of gelatin in said layer, and a water-soluble mordant dispersed in said gelatin matrix, said mordant being a compound which, when mixed in excess in an aqueous solution with said anionic dye at room temperature, forms a water-insoluble precipitate and a clear substantially colorless supernatant liquid, said hardened gelatin with said beads forming a water management material which absorbs the aqueous vehicle of said ink and has substantially no affinity for said dye and said mordant being a dye management material which forms a substantially immobile coacervate when contacted with said dye at room temperature in said aqueous vehicle.

15. An imaged ink jet acceptor sheet which comprises a support and, on said support, a layer containing hardened gelatin and, dispersed therein, a water-insoluble coacervate of a water-soluble ionic mordant compound and a water-soluble dye compound, and said layer further having dispersed therein, at or near its surface, non-porous polymer beads of 3 to 15 μm in diameter, the concentration of said beads being in the range from about 0.5 to 4 weight percent based on said hardened gelatin and said sheet having a surface roughness corresponding to a BEKK smoothness measurement from about 5 to 60 $sec^{-1}$ and a static coefficient of friction less than about 0.45.

16. An imaged ink jet acceptor sheet suitable for outdoor display which comprises a support and, on said support, an image layer containing a water-insoluble coacervate of a water-soluble mordant compound and a water-soluble dye compound, and coated over said image layer a transparent layer of hardened gelatin containing polymeric beads which protrude from said gelatin layer, said beads having diameters from about 3 to 15 μm and the concentration of said beads in said layer of hardened gelatin being from about 0.5 to 4 percent by weight based on the weight of gelatin.

* * * * *